US007780772B2

(12) United States Patent
Kolics et al.

(10) Patent No.: US 7,780,772 B2
(45) Date of Patent: Aug. 24, 2010

(54) ELECTROLESS DEPOSITION CHEMICAL SYSTEM LIMITING STRONGLY ADSORBED SPECIES

(75) Inventors: Artur Kolics, Dublin, CA (US); Igor Ivanov, Danville, CA (US)

(73) Assignee: Lam Research Corporation, Fremont, CA (US)

( * ) Notice: Subject to any disclaimer, the term of this patent is extended or adjusted under 35 U.S.C. 154(b) by 814 days.

(21) Appl. No.: 11/563,199

(22) Filed: Nov. 25, 2006

(65) Prior Publication Data

US 2009/0288594 A1 Nov. 26, 2009

Related U.S. Application Data

(60) Provisional application No. 60/740,133, filed on Nov. 25, 2005.

(51) Int. Cl.

| | |
|---|---|
| ***C23C 18/31*** | (2006.01) |
| ***C23C 18/34*** | (2006.01) |
| ***C23C 18/40*** | (2006.01) |
| ***C23C 18/44*** | (2006.01) |

(52) U.S. Cl. ..... 106/1.22; 106/1.27

(58) Field of Classification Search ..... 106/1.22, 106/1.27

See application file for complete search history.

(56) References Cited

U.S. PATENT DOCUMENTS

| | | | | |
|---|---|---|---|---|
| 2,430,581 | A * | 11/1947 | Pessel | 106/1.22 |
| 2,560,979 | A * | 7/1951 | Pessel | 106/1.26 |
| 3,893,865 | A * | 7/1975 | Franz et al. | 106/1.27 |
| 3,958,048 | A | 5/1976 | Donovan et al. | |
| 4,002,778 | A * | 1/1977 | Bellis et al. | 427/98.5 |
| 4,061,802 | A | 12/1977 | Costello | |
| 4,695,489 | A * | 9/1987 | Zarnoch et al. | 427/438 |
| 6,797,312 | B2 * | 9/2004 | Kong et al. | 427/58 |
| 6,800,121 | B2 | 10/2004 | Shahin | |
| 6,902,605 | B2 * | 6/2005 | Kolics et al. | 106/1.22 |
| 6,911,067 | B2 * | 6/2005 | Kolics et al. | 106/1.22 |
| 7,060,618 | B2 | 6/2006 | Inoue et al. | |
| 7,332,193 | B2 * | 2/2008 | Valverde et al. | 427/99.5 |
| 7,410,899 | B2 * | 8/2008 | Chen et al. | 438/678 |
| 2006/0083850 | A1 | 4/2006 | Valverde et al. | |

* cited by examiner

*Primary Examiner*—Helene Klemanski
(74) *Attorney, Agent, or Firm*—Martine Penilla & Gencarella, LLP

(57) ABSTRACT

An electroless deposition chemical system includes an electroless solution including a metal component, and a strongly adsorbed species component having a concentration less than a concentration of the metal component.

13 Claims, 4 Drawing Sheets

ELECTROLESS DEPOSITION CHEMICAL SYSTEM LIMITING STRONGLY ADSORBED SPECIES

CROSS-REFERENCE TO RELATED APPLICATION(S)

This application claims the benefit of U.S. Provisional Patent Application Ser. No. 60/740,133 filed Nov. 25, 2005.

TECHNICAL FIELD

The present invention relates generally to deposition systems, and more particularly to a system of chemical ingredients for electroless deposition.

BACKGROUND ART

There are various techniques being used in the electronic component industry for depositing or plating metal (e.g., copper, cobalt, gold, and nickel) onto the surfaces of electronic components. Such methods include, for example, chemical vapor deposition, metal sputtering, electroplating, and electroless metal deposition. Examples of where electroless metal deposition has been used in the electronic assembly industry are in the deposition of copper on printed circuit boards. In addition, in semiconductors, electroless deposition is used to deposit nickel on bonding packs, and in multichip modules, electroless deposition is used to deposit copper interconnects.

Electroless deposition of metal is typically carried out by first "activating" the surface of an electronic component by seeding or depositing a substance that will promote metal deposition onto the electronic component surface. However, it is possible that seeding may not be necessary. For example, on a substrate containing cobalt, nickel, rhodium, copper, or palladium, seeding may not be necessary to promote metal deposition. Seeding, when desired, can be accomplished for example through immersing the electronic component in a solution containing a seeding agent. Following activation, the electronic component is typically immersed in a solution that contains metal ions and a reducing agent. The reducing agent provides a source of electrons for the metal ions, so that metal ions near or at the surfaces of the electronic components are reduced to metal and plated out onto the electronic components.

Metal features may be formed by various techniques, depending on the desired semiconductor device. For example, the metal feature may be formed by chemical vapor deposition ("CVD"), physical vapor deposition ("PVD"), electroplating, or electroless plating. Electroless plating is used in the semiconductor industry to deposit thin, metal layers or features on the semiconductor device. Electroless plating is advantageous over other plating techniques because the plated metal is uniformly deposited and evenly coated on all surfaces, including edges and corners. In contrast to electroplating, electroless plating does not utilize electrical current to deposit the metal. However, electroless plating can only be used with particular metals because the metal must be catalytic in order to sustain the plating reaction.

Many semiconductor manufacturers are using copper in semiconductor devices. Copper wires are replacing aluminum wires because copper is more conductive and allows higher frequencies to be used with smaller line widths. Copper is also replacing aluminum as the metal in bond pads. However, the copper resistance to electromigration is degrading at high current densities used in advanced IC devices due to Cu atom migration along the top copper/dielectric interface. One of the solutions to solve copper electromigration problem is to terminate copper surface with a conductive Co alloy, which has significantly higher electromigration resistance but the sufficiently low solubility to provide good metallurgical bond between copper and metal film and at the same time sustain high electrical conductivity of copper wiring.

In most of the earlier publications including patents, the electroless cobalt/cobalt alloy electroless solutions contains sulfate or chloride ions either because they are added in together with cobalt sulfate or cobalt chloride as the source of metal ions or used in part of buffering agents (such as ammonium sulfate or ammonium chloride). However, sulfate and especially chloride ions are known to specifically and strongly bond to copper. Consequently, these ions influence any interfacial reactions, which include adsorption process. The chloride and sulfate ions will compete with metal ions on the surface, lowering the density of available adsorption sites and ultimately hindering the initiation process, a key step in the plating process.

Thus, a need still remains for an electroless deposition chemical system to provide improved stability of the process and produce same film on small isolated features as on large and dense areas of copper wiring. In view of the ever-increasing commercial competitive pressures, along with growing consumer expectations and the diminishing opportunities for meaningful product differentiation in the marketplace, it is critical that answers be found for these problems. Additionally, the need to save costs, improve efficiencies and performance, and meet competitive pressures, adds an even greater urgency to the critical necessity for finding answers to these problems.

Solutions to these problems have been long sought but prior developments have not taught or suggested any solutions and, thus, solutions to these problems have long eluded those skilled in the art.

DISCLOSURE OF THE INVENTION

The present invention provides an electroless deposition chemical system having an electroless solution including a metal component, and a strongly adsorbed species component having a concentration less than a concentration of the metal component.

Certain embodiments of the invention have other aspects in addition to or in place of those mentioned above. The aspects will become apparent to those skilled in the art from a reading of the following detailed description when taken with reference to the accompanying drawings.

BEST MODE FOR CARRYING OUT THE INVENTION

Figure 1:
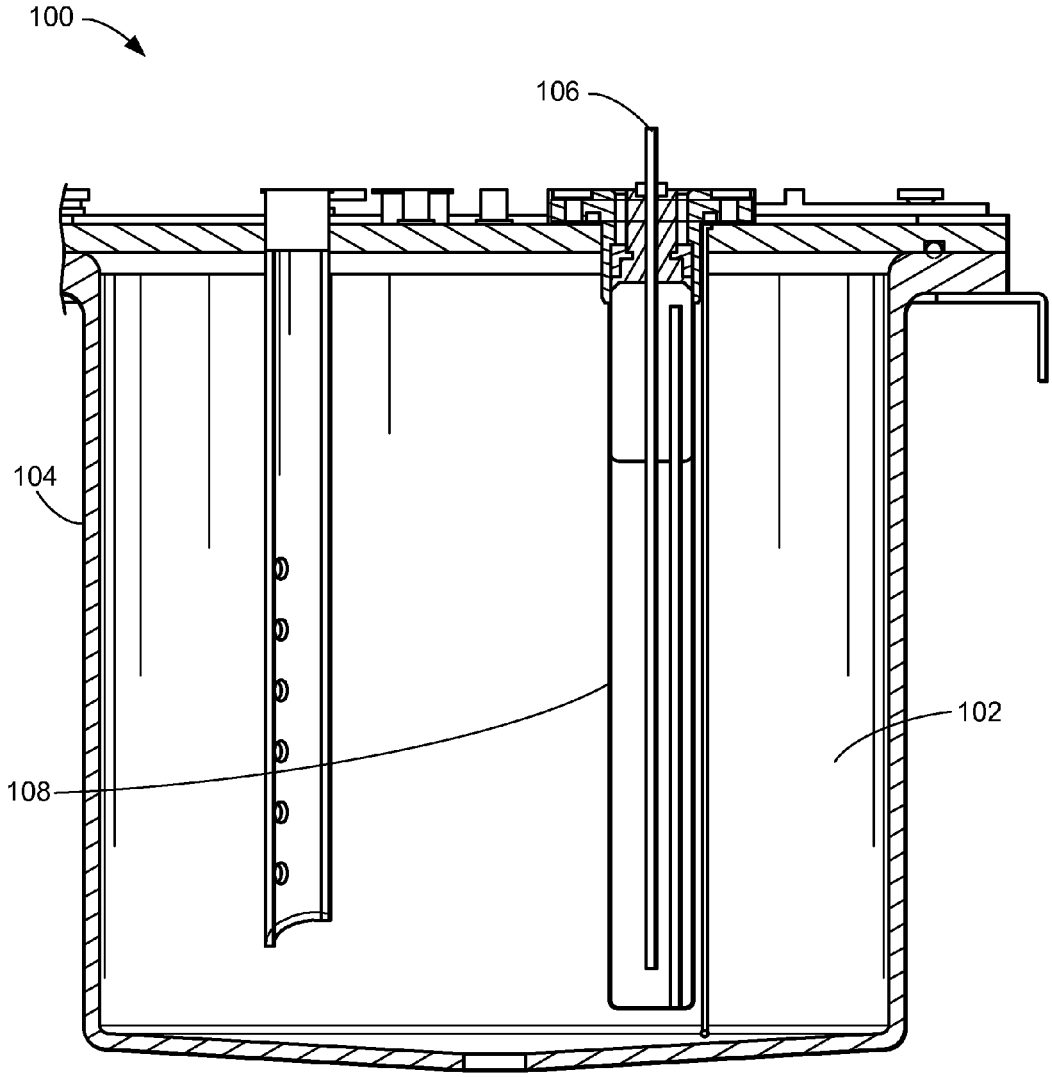
FIG. 1 is a cross-sectional view of an electroless deposition chemical system in a solution preparation phase in an embodiment of the present invention.

The following embodiments are described in sufficient detail to enable those skilled in the art to make and use the invention. It is to be understood that other embodiments would be evident based on the present disclosure, and that system, process, or mechanical changes may be made without departing from the scope of the present invention.

In the following description, numerous specific details are given to provide a thorough understanding of the invention. However, it will be apparent that the invention may be practiced without these specific details. In order to avoid obscuring the present invention, some well-known circuits, system configurations, and process steps are not disclosed in detail. Likewise, the drawings showing embodiments of the system are semi-diagrammatic and not to scale and, particularly, some of the dimensions are for the clarity of presentation and are shown greatly exaggerated in the drawing FIGs. Where multiple embodiments are disclosed and described, having some features in common, for clarity and ease of illustration, description, and comprehension thereof, similar and like features one to another will ordinarily be described with like reference numerals.

The term "on" as used herein means and refers to direct contact among elements. The term "processing" as used herein includes deposition of material, patterning, exposure, development, etching, cleaning, and/or removal of the material or trimming as required in forming a described structure. The term "system" as used herein means and refers to the chemical formulation and method of the present invention in accordance with the context in which the term is used.

Referring now to FIG. 1, therein is shown a cross-sectional view of an electroless deposition chemical system 100 in a solution preparation phase in an embodiment of the present invention. The electroless deposition chemical system 100 includes an electroless solution 102, such as a deposition solution, or a plating solution, for depositing films, such as metal alloy capping for copper interconnects. Metal alloys can include metals, such as vanadium (V), chromium (Cr), tungsten (W), molybdenum (Mo), ruthenium (Ru), palladium (Pd), tin (Sn), rhenium (Re), phosphorus (P), boron (B), silicon (Si), aluminum (Al), or a combination thereof. As an example, the electroless solution 102 can include cobalt ions, nickel ions, or an alloy thereof.

The electroless solution 102 can be stored in an electroless solution tank 104, such as a "Blue 29 CuSeal CDU". The electroless solution tank 104 can include an inlet 106 and optionally a humidifier 108. The inlet 106 can provide introduction of components and additional chemical types into the electroless solution 102 into the electroless deposition chemical system 100 resulting in the electroless solution 102 having an acidity of about pH=8-14. The electroless solution 102 maintains predetermined levels or concentrations of components or additional chemical types during a processing, such as a multi step process including as an example: surface preparation, initiation, optional rinse, deposition, and post deposition treatments.

Maintaining predetermined levels in the electroless solution 102 can require additional de-ionized water (DI water). The de-ionized water can be added by humidifying the components or chemical types through the humidifier 108. Components or additional chemical types bubbled through the humidifier 108 include additional de-ionized water during introduction into the electroless solution 102. De-ionized water can also be added by a replenishment process wherein de-ionized water is introduced to the electroless solution 102 without the need for the humidifier 108.

It has been unexpectedly discovered that the electroless deposition chemical system 100 provides significantly less thickness variation of deposited film across different feature sizes due in part to significantly less sensitivity to pattern density.

Figure 2:
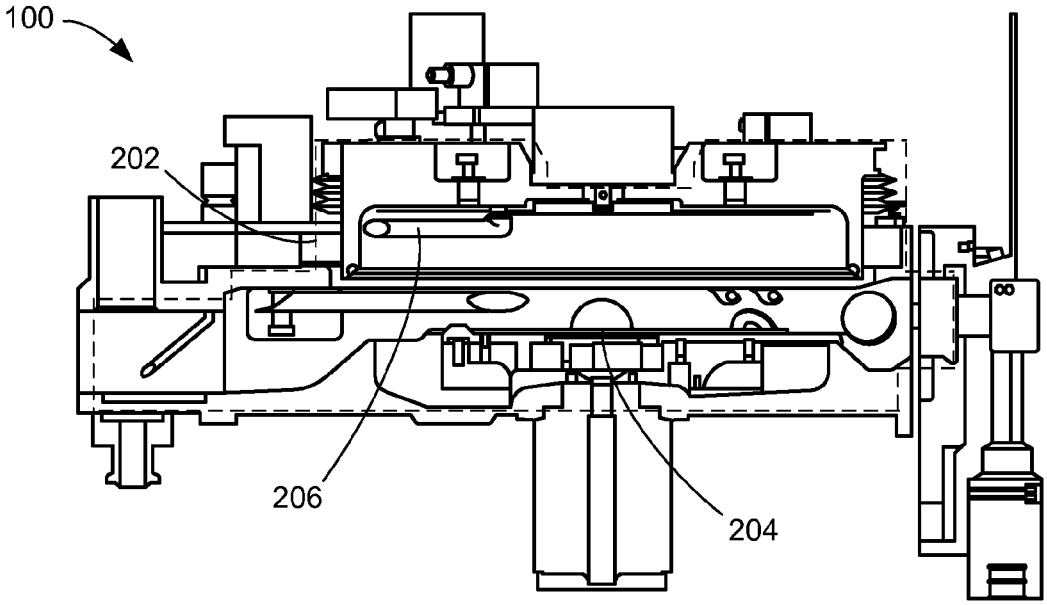
FIG. 2 is a cross-sectional view of the electroless deposition chemical system in a surface treatment and initiation phase.

Referring now to FIG. 2, therein is shown a cross-sectional view of the electroless deposition chemical system 100 in a surface treatment and initiation phase. The electroless deposition chemical system 100 includes an electroless deposition chamber 202. The electroless deposition chamber 202 includes an outer chamber 204 and a lower dispense arm 206. The lower dispense arm 206 is active and the outer chamber 204 is sealed. The outer chamber 204 can be purged for surface treatment and initiation of a work piece (not shown). Reducing agents can be introduced to surfaces of the work piece in an initiation process. The electroless deposition chamber 202 provides control for the surface treatment and initiation environment of the electroless deposition chemical system 100 including controlling concentrations of reducing agents in the electroless solution 102 of FIG. 1.

It has been unexpectedly discovered that the electroless solution 102 increases the available adsorption sites and shortens the initiation phase due in part to eliminating or limiting strongly bound anions or molecules not part of the deposition process.

Figure 3:
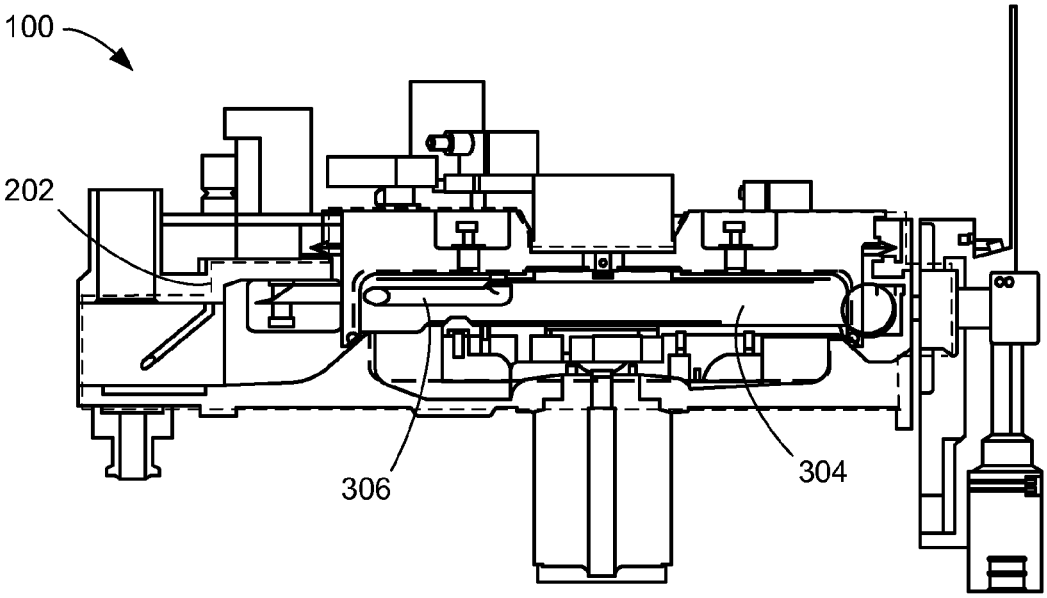
FIG. 3 is a cross-sectional view of the electroless deposition chemical system in a deposition phase.

Referring now to FIG. 3, therein is shown a cross-sectional view of the electroless deposition chemical system 100 in a deposition phase. The electroless deposition chemical system 100 includes the electroless deposition chamber 202. As in FIG. 2, the outer chamber 204 of FIG. 2 is sealed. The electroless deposition chamber 202 includes an inner chamber 304 and an upper dispense arm 306. The upper dispense arm 306 is active and the inner chamber 304 is sealed. The inner chamber 304 can be purged for deposition on the work piece. Reduced concentrations of reducing agents can provide stability in a deposition process. The electroless deposition chamber 202 provides control for the deposition environment of the electroless deposition chemical system 100 including controlling concentrations of the reducing agents in the electroless solution 102 of FIG. 1.

As an example of deposition, an adsorption reaction can include the oxidation of dimethylamine borane on the surface of copper. In order to allow the reaction to proceed, the dimethylamine borane molecule has to first adsorb on a copper substrate. The electroless deposition chemical system 100 eliminates or limits strongly bound anions or molecules that are not part of the deposition process, providing a significantly more uniform adsorption surface. The significantly more uniform adsorption surface improves interfacial reactions such as bonding cobalt ions to copper substrates.

It has been unexpectedly discovered that the electroless solution 102 increases the available adsorption sites and shortens the initiation phase due in part to eliminating or limiting strongly bound anions or molecules not part of the deposition process.

Figure 4A:
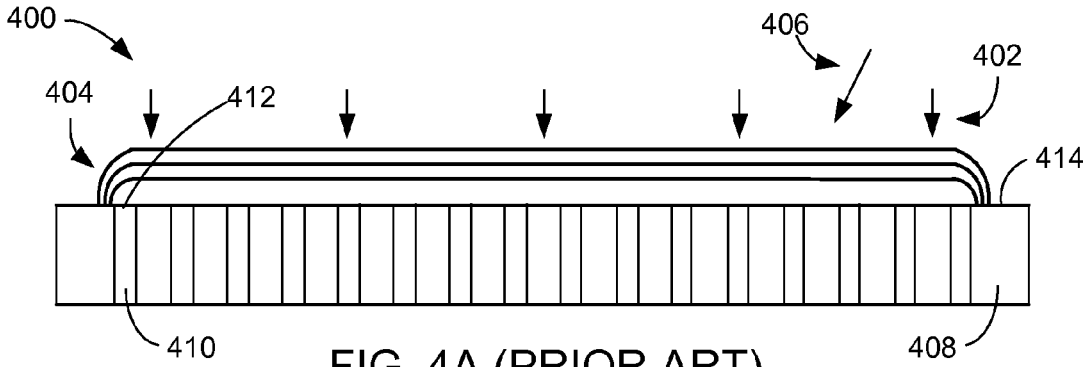
FIG. 4A (PRIOR ART)
FIGS. 4A and 4B (PRIOR ART) are cross-sectional views of a proposed reaction mechanism of an electroless deposition chemical system containing strongly adsorbed species.
Figure 4B:
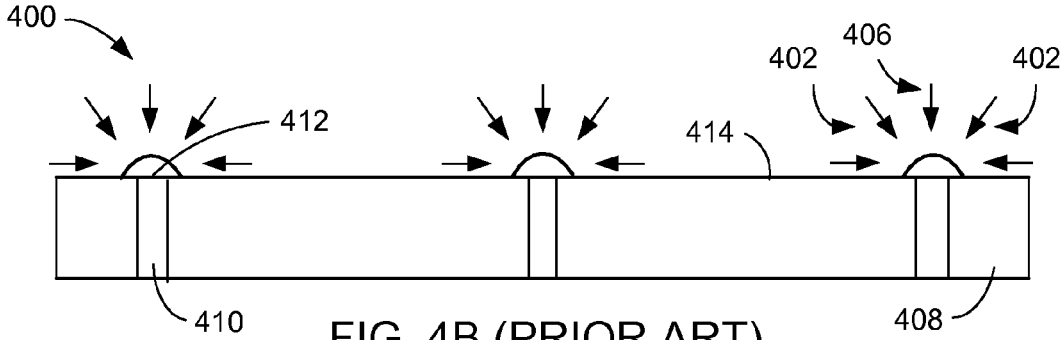
FIG. 4B (PRIOR ART)

Referring now to FIGS. 4A and 4B (PRIOR ART), therein is shown cross-sectional views of a proposed reaction mechanism of an electroless deposition chemical system 400 containing strongly adsorbed species component 402. FIG. 4B is a more detailed view of the structure of FIG. 4A. An electroless solution 404 can include metal components 406 to be applied over a substrate 408. The substrate 408 can include connectors 410, such as copper contacts, having adsorption sites 412 on a deposition surface 414. The adsorption sites 412 of the deposition surface 414 provide a region for exposure to the electroless solution 404 having the strongly adsorbed species component 402 and the metal components 406.

Figure 5A:
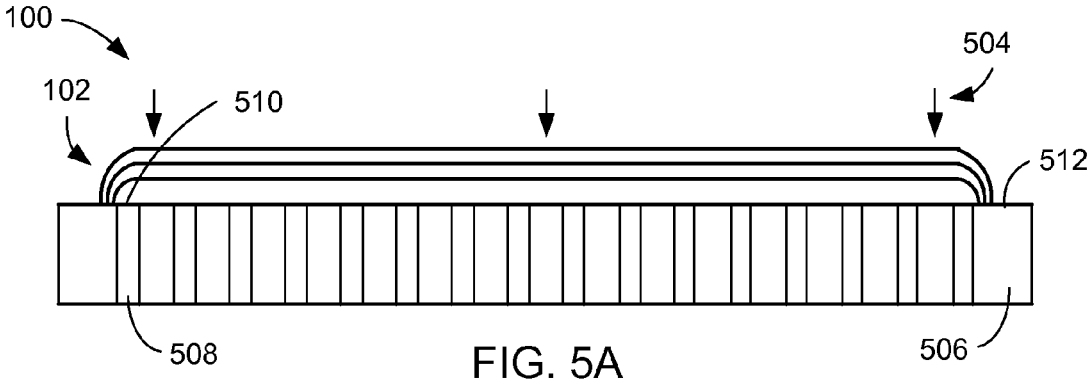
FIGS. 5A and 5B are cross-sectional views of a proposed reaction mechanism of electroless deposition chemical system without the strongly adsorbed species.
Figure 5B:
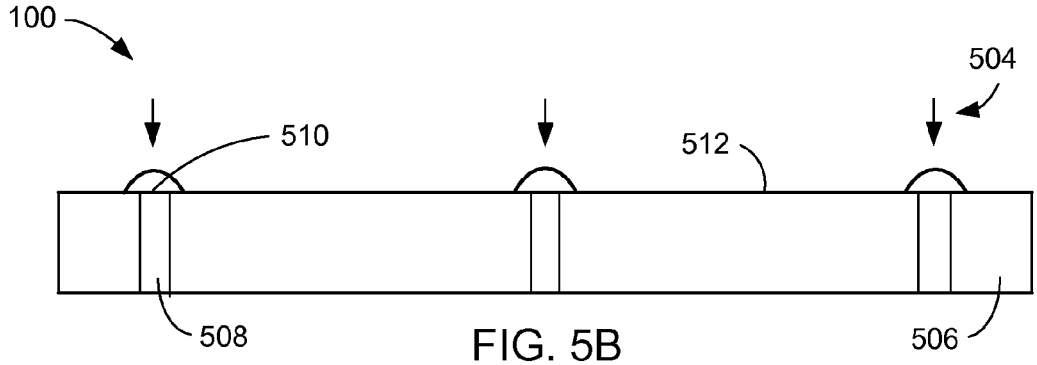

Referring now to FIGS. 5A and 5B, therein is shown cross-sectional views of a proposed reaction mechanism of the electroless deposition chemical system 100 without the strongly adsorbed species component 402 of FIGS. 4A and 4B. FIG. 5B is a more detailed view of the structure of FIG. 5A. The electroless solution 102 of FIG. 1 can include metal components 504 for application over a substrate 506. The substrate 506 can include connectors 508, such as copper contacts, having adsorption sites 510 of a deposition surface 512. The adsorption sites 510 of the deposition surface 512 provide a region for exposure to the electroless solution 102 having the metal components 504.

The electroless solution 102 can include the metal components 504 such as cobalt, nickel, copper, tungsten, molybdenum, ruthenium, copper, rhodium, platinum, and components, such as complexing agents, reducing agents, ions, acidity adjustor, such as pH adjustor. Additional chemical types can also be added separately or in any combination thereof. These additional chemical types can include buffering agents, such as any acids, amines, or amino acids that have at least one of their logarithm of protonation constant (pK value) between eight and twelve. The additional chemical types can also include surfactants, oxygen scavengers, brighteners, corrosion inhibitors, or stabilizers. Excluded from these additional chemical types are the strongly adsorbed species component 402 such as any sulfate, sulfonate, halide (except fluoride), phosphate, polyphosphate, unsaturated organic acid, aromatic compound, heterocyclic compound, or thiol concentration of less than one percent of the chemical concentration of cobalt ions.

As an example, the electroless solution 102 can contain one hundredth to one tenth moles per cubic decimeter (mol $dm^{-3}$) cobalt ions, citrate ion concentration two to seven times that of cobalt ions, hypophosphite ion concentration one to five times that of cobalt ions, boric acid (as buffering agent) concentration zero to ten times that of cobalt ions, and alloying metal ion concentration up to one times that of cobalt ions. Another example of the electroless solution 102 can contain six hundredths mol $dm^{-3}$ cobalt ions, forty hundredths mol $dm^{-3}$ citrate, thirty hundredths mol $dm^{-3}$ hypophosphite ions, twenty-five hundredths mol $dm^{-3}$ boric acid, and seven hundredths mol $dm^{-3}$ tungstate ions, where pH of the electroless solution 102 is about pH=8.8–12.

The electroless deposition chemical system 100 provides the absence or limited amount of such strongly bound anions or molecules from the electroless solution 102 that are not taking part in the actual deposition process. This is achieved primarily by employing metal sources including metal hydroxide such as $Co(OH)_2$, metal citrate such as $CO_3(C_6H_5O_8)_2x2H_2O$, metal acetate such as $Co(C_2H_3O_2)_2.4H_2O$ or metal hypophosphite such as $Co(H_2PO_2)_2$. The most commonly used of the strongly adsorbed species component 402 in the electroless solution 102 that are not taking part in the actual deposition process (not reducing agents, not reducible metal ions, not primary complexing agent) are sulfate and chloride ions.

It has been unexpectedly discovered that a concentration of the strongly adsorbed species ions of less than one percent of a concentration of cobalt ions provides improved adsorption sites, initiation process and thickness variation of deposited film.

Figure 6A:
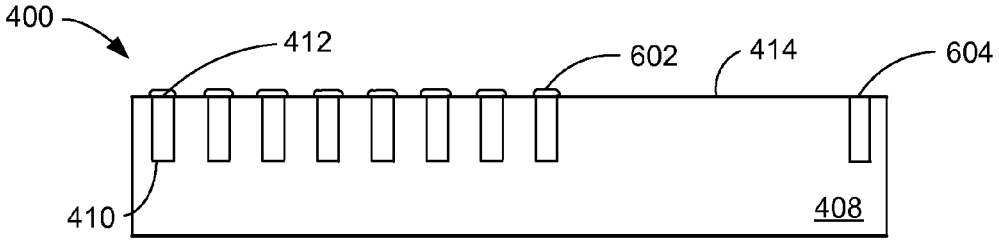
FIG. 6A (PRIOR ART)
FIG. 6A is a cross-sectional view of a cross-sectional view of the electroless deposition chemical system in a film deposition phase.

Referring now to FIG. 6A (PRIOR ART), therein is shown a cross-sectional view of the electroless deposition chemical system 400 in a film deposition phase. The electroless deposition chemical system 400 includes the connectors 410 having the adsorption sites 412 on the deposition surface 414. The metal components 406 of FIG. 4 can include a metal film 602, such as cobalt, or nickel, or combination thereof. The metal film can be deposited over the adsorption sites 412. An isolated feature film 604 including the metal components 406 is formed over one of the adsorption sites 412 with limited or no deposition of the metal film 602.

Figure 6B:
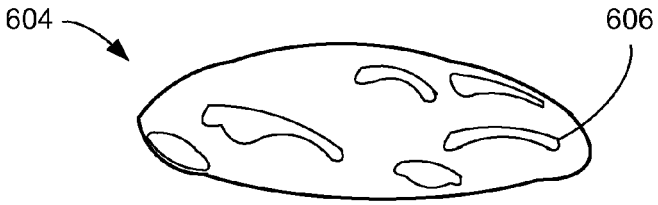
FIG. 6B (PRIOR ART)
FIG. 6B (PRIOR ART) is an illustration of a scanning electron microscope (SEM) image of an isolated feature processed with the electroless solution containing strongly adsorbed species.

Referring now to FIG. 6B (PRIOR ART), therein is shown a scanning electron microscope (SEM) image of an isolated feature processed with the electroless solution 404 of FIG. 4A containing the strongly adsorbed species component 402 of FIG. 4A. The electroless deposition chemical system 400 of FIG. 4A with the electroless solution 404 provides the isolated feature film 604 having planar dimensions significantly larger than planar dimensions of the connectors 410 of FIG. 4A. The isolated feature film 604 also includes grain decorations 606 having dimensions of a significant percentage of dimensions of the isolated feature film 604.

Figure 7A:
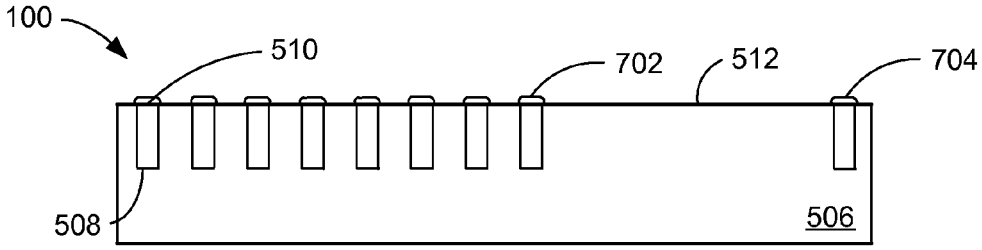
FIG. 7A is a cross-sectional view of the electroless deposition chemical system in a film deposition phase.

Referring now to FIG. 7A, therein is shown a cross-sectional view of the electroless deposition chemical system 100 in a film deposition phase. The electroless deposition chemical system 100 includes the connectors 508 having the adsorption sites 510 on the deposition surface 512. The metal components 504 of FIG. 5 can include a metal film 702, such as cobalt, nickel, or combination thereof. The metal film can be deposited over the adsorption sites 510. An isolated feature film 704 including the metal components 504 is formed over one of the adsorption sites 510 with a deposition of the metal film 602.

Figure 7B:
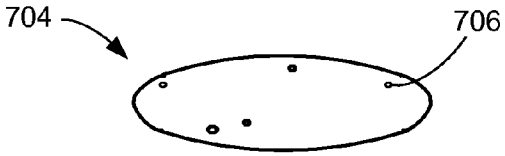
FIG. 7B is an illustration of a SEM image of an isolated feature processed with the electroless solution, which does not contain strongly adsorbed species.

Referring now to FIG. 7B, therein is shown a SEM image of an isolated feature processed with the electroless solution 102, which does not contain the strongly adsorbed species component 402 of FIG. 4A. The electroless deposition chemical system 100 of FIG. 1 with the electroless solution 102 of FIG. 1 provides the isolated feature film 704 having planar dimensions significantly smaller than planar dimensions of the isolated feature film 604 of FIG. 6B. The isolated feature film 704 also includes grain decorations 706 having dimensions of a small percentage of dimensions of the isolated feature film 704. Further, the grain decorations 706 have planar dimensions significantly smaller than dimensions of the grain decorations 606 of FIG. 6.

As an example of deposition, an adsorption reaction can include the oxidation of dimethylamine borane on the surface of copper. In order to allow the reaction to proceed, the dimethylamine borane molecule has to first adsorb on a copper substrate. The electroless deposition chemical system 100 eliminates or limits strongly bound anions or molecules that are not part of the deposition process, providing a significantly more uniform adsorption surface. The significantly more uniform adsorption surface improves interfacial reactions such as bonding cobalt ions to copper substrates.

It has been unexpectedly discovered that the electroless solution 102 provides significantly reduced grain decoration such as roughness, pits or pinholes, and non-uniform growth on different size and patterned features.

Figure 8:
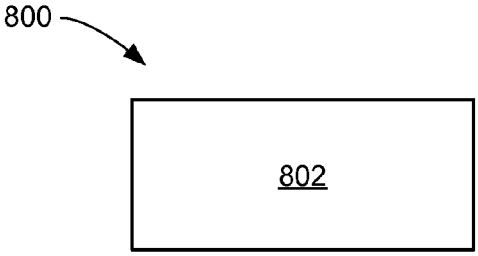
FIG. 8 is a flow chart of an electroless deposition chemical system for providing the electroless solution in an embodiment of the present invention.

Referring now to FIG. 8, therein is shown a flow chart of an electroless deposition chemical system 800 for providing the electroless solution in an embodiment of the present invention. The system 800 includes providing an electroless solution including a metal component, and a strongly adsorbed species component having a concentration less than a concentration of the metal component in a block 802.

It has been discovered that the present invention thus has numerous aspects.

A principle aspect that has been unexpectedly discovered is electroless deposition or plating of a metal alloy capping layer for interconnects, such as copper, in semiconductor manufacturing.

Another aspect is that the electroless solution provides limiting or eliminating of strongly bound anions or molecules that are not part of the deposition process. The most commonly used strongly adsorbed species that are limited or eliminated are sulfate and chloride ions. The electroless solution also eliminates the need for $CoSO_4x7H_20$, $CoCl_2x6H_2O$ or buffering agents such as $(NH_4)_2SO_4$ and $NH_4Cl$.

Yet another aspect is that the present invention can also include components in the electroless solution that include but are not limited to complexing agents, ions, or acidity adjustors. The present invention can further include additional chemical types such as buffering agents, surfactants, oxygen scavengers, brighteners, corrosion inhibitors, or stabilizers.

Yet another aspect is that the present invention provides superior coverage for deposited film. The film deposited from the electroless solution provides significantly improved uniformity of the deposited film due to less sensitivity to pattern density across different feature sizes.

Yet another important aspect of the present invention is that it valuably supports and services the historical trend of reducing costs, simplifying systems, and increasing performance.

These and other valuable aspects of the present invention consequently further the state of the technology to at least the next level.

Thus, it has been discovered that the electroless deposition chemical system of the present invention furnish important and heretofore unknown and unavailable solutions, capabilities, and functional aspects. The resulting processes and configurations are straightforward, cost-effective, uncomplicated, highly versatile, accurate, sensitive, and effective, and can be implemented by adapting known components for ready, efficient, and economical manufacturing, application, and utilization.

While the invention has been described in conjunction with a specific best mode, it is to be understood that many alternatives, modifications, and variations will be apparent to those skilled in the art in light of the aforegoing description. Accordingly, it is intended to embrace all such alternatives, modifications, and variations, which fall within the scope of the included claims. All matters hithertofore set forth herein or shown in the accompanying drawings are to be interpreted in an illustrative and non-limiting sense.

What is claimed is:

1. An electroless deposition chemical system comprising:

providing an electroless solution including:

a metal component that includes metal ions; and a strongly adsorbed species component, the strongly adsorbed species component having a concentration of less than one percent of a concentration of the metal component, the strongly adsorbed species including one of sulfate anions, chloride anions, or a combination thereof;

wherein the metal component includes vanadium, chromium, tungsten, molybdenum, ruthenium, copper, palladium, tin, rhenium, phosphorus, boron, silicon and aluminum or an alloy thereof.

2. The system as claimed in claim 1 wherein providing the electroless solution includes providing the electroless solution having cobalt ions, nickel ions or a combination thereof.

3. The system as claimed in claim 1 further comprising adsorbing a metal film of the metal component over a substrate.

4. The system as claimed in claim 1 further comprising providing an electroless solution tank or an electroless deposition chamber containing the electroless solution.

5. An electroless deposition chemical system comprising:

providing an electroless solution including:

a metal component including metal ions; and a strongly adsorbed species component, the strongly adsorbed species component having a concentration less than one percent of a concentration of the metal component, the strongly adsorbed species including one of sulfate anions, chloride anions, or a combination thereof;

wherein providing the electroless solution includes providing one hundredth to one tenth moles per cubic decimeter cobalt ions, citrate ion concentration two to seven times that of the cobalt ions, hypophosphite ion concentration one to five times that of the cobalt ions and a buffering agent concentration zero to ten times that of the cobalt ions.

6. The system as claimed in claim 5 wherein providing the electroless solution includes providing cobalt ions from $Co(OH)_2$, $Co_3(C_6H_5O_8)_2x2H_2O$, $Co(C_2H_3O_2)_2.4H_2O$, or $Co(H_2PO_2)_2$.

7. The system as claimed in claim 5 further comprising adsorbing the metal component over a substrate, the metal component being selected from a group consisting of vanadium, chromium, tungsten, molybdenum, ruthenium, palladium, tin, rhenium, phosphorus, boron, silicon and aluminum or an alloy thereof.

8. An electroless deposition chemical system comprising:

an electroless solution including, a metal component that includes metal ions; and a strongly adsorbed species component, the strongly adsorbed species component having a concentration of less than one percent of a concentration of the metal component, the strongly adsorbed species including one of sulfonate, halide, phosphate, polyphosphate, unsaturated organic acid, aromatic compound, heterocyclic compound, thiol, or a combination thereof;

wherein the metal component includes vanadium, chromium, tungsten, molybdenum, ruthenium, copper, palladium, tin, rhenium, phosphorus, boron, silicon and aluminum or an alloy thereof.

9. The system as claimed in claim 8 wherein the electroless solution includes cobalt ions, nickel ions or a combination thereof.

10. The system as claimed in claim 8 further comprising:

a substrate; and a metal film of the metal component over the substrate.

11. The system as claimed in claim 8 further comprising an electroless solution tank or an electroless deposition chamber containing the electroless solution.

12. An electroless deposition chemical system comprising: an electroless solution including, a metal component that includes metal ions; and a strongly adsorbed species component, the strongly adsorbed species component having a concentration of less than one percent of a concentration of the metal component, the strongly adsorbed species including one of sulfonate, halide, phosphate, polyphosphate, unsaturated organic acid, aromatic compound, heterocyclic compound, thiol, or a combination thereof;

wherein the electroless solution includes cobalt ions from $Co(OH)_2$, $Co_3(C_6H_5O_8)_2x2H_2O$, $Co(C_2H_3O_2)_2.4H_2O$, or $Co(H_2PO_2)_2$.

13. An electroless deposition chemical system comprising: an electroless solution including, a metal component that includes metal ions; and a strongly adsorbed species component, the strongly adsorbed species component having a concentration of less than one percent of a concentration of the metal component, the strongly adsorbed species including one of sulfonate, halide, phosphate, polyphosphate, unsaturated organic acid, aromatic compound, heterocyclic compound, thiol, or a combination thereof;

wherein the electroless solution includes one hundredth to one tenth moles per cubic decimeter cobalt ions, citrate ion concentration two to seven times that of the cobalt ions, hypophosphite ion concentration one to five times that of the cobalt ions and a buffering agent concentration zero to ten times that of the cobalt ions.

* * * * *